US011629478B2

(12) United States Patent
Pino, Jr.

(10) Patent No.: US 11,629,478 B2
(45) Date of Patent: Apr. 18, 2023

(54) METHOD OF EXPOSING A UTILITY BURIED BELOW A ROADWAY AND A BORE HOLE CLEANING DEVICE

(71) Applicant: CCIIP LLC, New York, NY (US)

(72) Inventor: Angelo J. Pino, Jr., New York, NY (US)

(73) Assignee: CCIIP LLC, New York, NY (US)

( * ) Notice: Subject to any disclaimer, the term of this patent is extended or adjusted under 35 U.S.C. 154(b) by 94 days.

(21) Appl. No.: 17/308,281

(22) Filed: May 5, 2021

(65) Prior Publication Data

US 2021/0270009 A1 Sep. 2, 2021

Related U.S. Application Data

(63) Continuation of application No. 17/017,919, filed on Sep. 11, 2020, now Pat. No. 11,028,556.

(60) Provisional application No. 62/993,735, filed on Mar. 24, 2020, provisional application No. 62/969,295, filed on Feb. 3, 2020.

(51) Int. Cl.

| | |
|---|---|
| ***E02F 5/00*** | (2006.01) |
| ***E02F 3/90*** | (2006.01) |
| ***E02F 3/92*** | (2006.01) |

(52) U.S. Cl.

CPC ..... *E02F 5/003* (2013.01); *E02F 3/907* (2013.01); *E02F 3/925* (2013.01)

(58) Field of Classification Search

CPC . E02F 5/003; E02F 3/907; E02F 3/925; E02F 3/9225; E02F 3/9268

See application file for complete search history.

(56) References Cited

U.S. PATENT DOCUMENTS

| | | | |
|---|---|---|---|
| 4,668,548 | A | 5/1987 | Lankard |
| 4,744,693 | A | 5/1988 | Smith |
| 4,812,078 | A | 3/1989 | Rivard |
| 5,244,304 | A | 9/1993 | Weil |
| 5,913,638 | A | 6/1999 | Lansdale |
| 7,837,050 | B2 | 11/2010 | Maybury |
| 7,914,618 | B1 | 3/2011 | Krozel |
| 9,203,226 | B2 | 12/2015 | Miller |
| 9,485,468 | B2 | 11/2016 | Pino |
| 10,311,102 | B2 | 6/2019 | Pino |

(Continued)

FOREIGN PATENT DOCUMENTS

| | | | |
|---|---|---|---|
| CA | 2348062 | 11/2001 | |
| CA | 2940214 A1 * | 2/2017 | ..... E02F 3/8825 |

(Continued)

OTHER PUBLICATIONS

Camplex Fiber Optic Extender, http://www.camplex.com/product.aspx?item=CMX-TACNGO-SDI, Oct. 17, 2017 pp. 1-2.

(Continued)

*Primary Examiner* — Jamie L McGowan

(74) *Attorney, Agent, or Firm* — Jeffrey S. Melcher; Melcher Patent Law PLLC

(57) ABSTRACT

A method of exposing a buried utility under a roadway by cutting an access hole in the roadway, vacuuming away dirt surrounding the buried utility, and spraying at least one of pressurized water or compressed air into the dirt to loosen the dirt. A vacuum device having a vacuum nozzle, a compressed air nozzle, and a pressurized water nozzle.

10 Claims, 16 Drawing Sheets

(56) References Cited

U.S. PATENT DOCUMENTS

| | | | | |
|---|---|---|---|---|
| 10,571,045 | B2 | 2/2020 | Pino | |
| 10,571,047 | B2 | 2/2020 | Pino | |
| 10,641,414 | B2 | 5/2020 | Pino | |
| 10,808,379 | B1 | 10/2020 | Pino | |
| 2004/0149174 | A1 | 8/2004 | Farrington | |
| 2005/0036749 | A1 | 2/2005 | Vogel | |
| 2013/0011198 | A1 | 1/2013 | Purcell | |
| 2013/0189060 | A1* | 7/2013 | Lamonte | E02F 3/8825 414/507 |
| 2013/0284070 | A1 | 10/2013 | Dubey | |
| 2015/0125218 | A1 | 5/2015 | Gustavsson | |
| 2016/0376767 | A1 | 12/2016 | Miller | |
| 2018/0106015 | A1 | 4/2018 | Pino | |
| 2018/0156357 | A1 | 6/2018 | Pino | |
| 2018/0292027 | A1 | 10/2018 | Pino | |
| 2019/0086002 | A1 | 3/2019 | Pino | |
| 2019/0226603 | A1 | 7/2019 | Pino | |

FOREIGN PATENT DOCUMENTS

| | | | | |
|---|---|---|---|---|
| GB | 2332007 A * | 6/1999 | | E02F 3/9206 |
| WO | 2016/088083 | 9/2016 | | |

OTHER PUBLICATIONS

Corning Fiber Optic Extenders, https://www.corning.com/worldwide/en/products/communication-networks/products/fiber.html,Oct. 17, 2017 pp. 1-7.
SC Polymer, https://www.surecretedesign.com/product/liquid-concrete-polymer/, Oct. 17, 2017 p. 1.
SCAG Giant VAC, http://www.giant-vac.com/, Oct. 17, 2017pp. 1-2.
DR Power Vacuum, https://www.drpower.com/, Oct. 17, 2017pp. 1-2.
Billy Goat vaccum, www.billygoat.com, Oct. 17, 2017pp. 1-2.
Ditch Witch, www.ditchwitch.com, Oct. 17, 2017p. 1.
Trenchers, www.vermeer.com, Oct. 17, 2017 pp. 1-15.
Trenchers, www.samarais.com, Oct. 17, 2017pp. 1-2 .
King, "Google Fiber finishes digging very shallow grave in Louisville, KY. #RIP," https:|www.pocketables.com/2019/021 Joogle-fiber-finishes-digging-very-shallow-grave-in-louisville-ky-rip.html, published on Pocketable on Feb. 7, 2019, pp. 1-9.
Blum, "Microtrenching fail drives Google Fiber out of Louisville," https:|www.tellusventure.com/blog/microtrenching- ail-drives-google-fiber-out-of-louisville/, published on Tellus Venture Associates, Feb. 8, 2019, pp. 1-3.
Otts, "Where is Google Fiber? Mostly in the Highlands, records show," hllps://www.wdrb.com/news/business/sunday- 3edition-where-is-google-fiber-moslly-in-the-highlands/article _ 569112e0-421 e-58ef-be24-c2e42e5e53d2.html, published in the Sunday Edition, WDRB, Sep. 14, 2018, pp. 1-10.
FASTRACT 400 material data sheet Aug. 23, 2018, pp. 1-4.
https://www.youtube.com/watch?v=0CGi92UK4Tw, Optic Fiber nastro in Torino, published Mar. 7, 2016, Garbin Group, pp. 1-3.
https://www.youtube.com/watch?v=klWluvLc5cl, The Ditch Witch MT12 MicroTrencher: Faster, Cleaner, Better, published Jun. 14, 2016, pp. 1-4.
https://www.youtube.com/watch?v=VWryq2nOA3U, Micro trenching | MTT-system, published Sep. 26, 2016, www.mttsystem.com, pp. 1-3.
https://www.youtube.com/watch?v=7xf2Ujax9hU, published Nov. 10, 2011, Micro-Trenching—alternative Möglichkeit zur Verlegung von Glasfaserkabeln, Schmidt@buglas.de, pp. 1-3.
https://www.youtube.com/watch?v=OlxA3gqNPkE, BVS-net, microtrenching, published Nov. 29, 2014, www. bvs-net.eu, pp. 1-3.
https://www.youtube.com/watch?v=929vJtv5Uxw, www, dellcron.com, published Feb. 10, 2018, pp. 1-3.
https://www.youtube.com/watch?v=8p4xHlwuMhl, Americicom, www.americomtech.com, Microtrenching, published Jun. 10, 2017, pp. 1-3.
https://www.youtube.com/watch?v=57NBkB1y8iM, published Jan. 14, 2014, KNET Micro Trenching Solution, pp. 1-4.

* cited by examiner

METHOD OF EXPOSING A UTILITY BURIED BELOW A ROADWAY AND A BORE HOLE CLEANING DEVICE

FIELD OF THE INVENTION

The invention generally relates to a method for exposing a utility buried below a roadway and a device for removing dirt surrounding a buried utility.

BACKGROUND OF THE INVENTION

Installing new optical fiber networks to a location is expensive and time consuming. There is a great need for faster and less expensive installation of optical fiber.

During installation of the optical fiber, a microtrench is cut in a roadway, the optical fiber and/or innerduct/microduct is laid in the microtrench and then a fill and sealant are applied over the optical fiber and/or innerduct/microduct to protect them from the environment. Methods of microtenching that can be utilized in the present invention include the method described in my previous U.S. patent publication Nos. 20190226603, 20190086002, 20180292027, 20180156357, and 20180106015, the complete disclosures of which are incorporated in their entirety herein by reference.

Before cutting a microtrench in a roadway, the city and utility providers must be notified. The city and or utility providers personnel locate contractor will locate and mark buried utilities on the roadway. When a microtrench must cross a buried utility, the buried utility must first be exposed, which requires cutting through the roadway and then removing the dirt surrounding the buried utility. Currently, core saws, concrete saws, core drills and jack hammers drill are used to break through roadway, and then the dirt surrounding the buried utility must be removed which is slow. There is a need for a faster and safer method to expose the buried utility.

SUMMARY OF THE INVENTION

The present invention solves the problem of removing dirt surrounding a buried utility without damaging the buried utility and in a far faster manner than conventional methods of removing the dirt.

Objectives of the invention can be obtained by a method of removing dirt surrounding a utility buried under a roadway comprising:

- inserting a vacuum nozzle into an access hole in a roadway above a buried utility;
- applying vacuum to the vacuum nozzle by source of vacuum to vacuum away dirt surrounding the buried utility to expose the buried utility; and
- spraying at least one of pressurized water or compressed air into the dirt to loosen the dirt surrounding the buried utility.

The above objectives and other objectives can also be obtained by a vacuum device for removing dirt surrounding a utility buried under a roadway comprising:

- a vacuum nozzle having a diameter of about 2 to about 24 inches; and
- a device configured for spraying at least one of water or compressed air into the hole to loosen the dirt surrounding the buried utility.

DETAILED DESCRIPTION OF THE INVENTION

Figure 1:
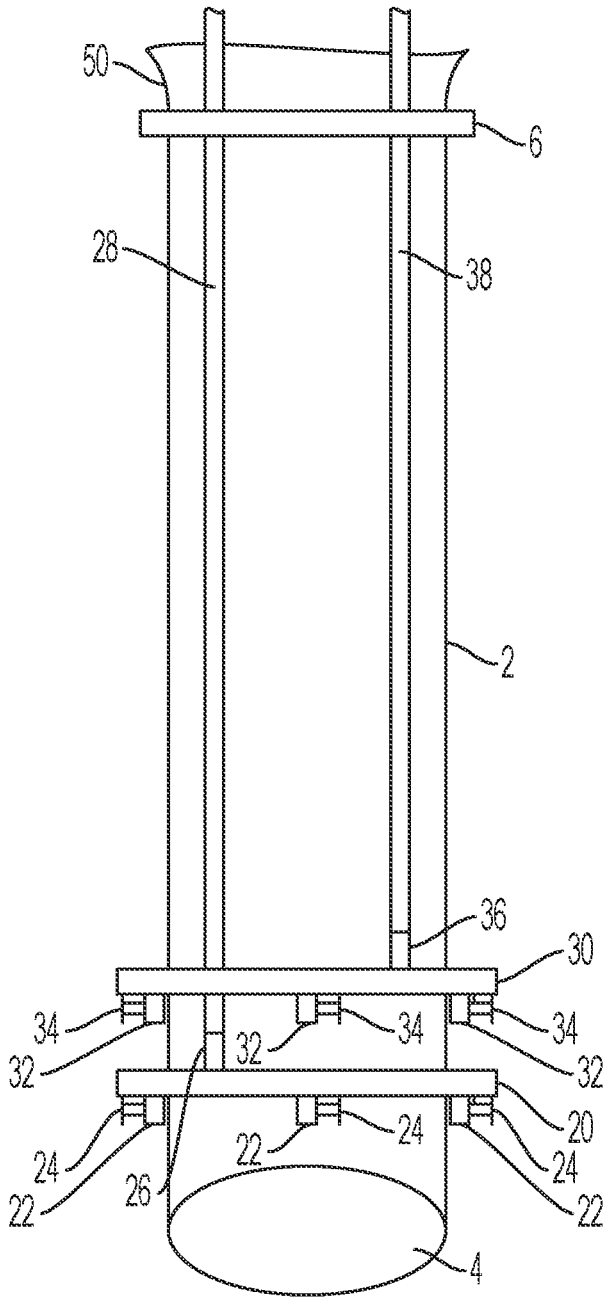
FIG. 1 illustrates a vacuum nozzle.
Figure 2:
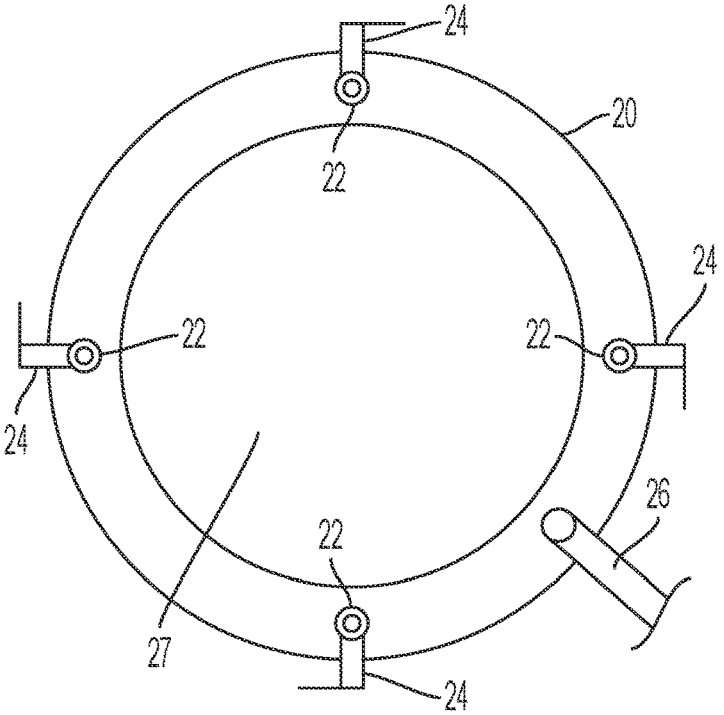
FIG. 2 illustrates a compressed air manifold.
Figure 3:
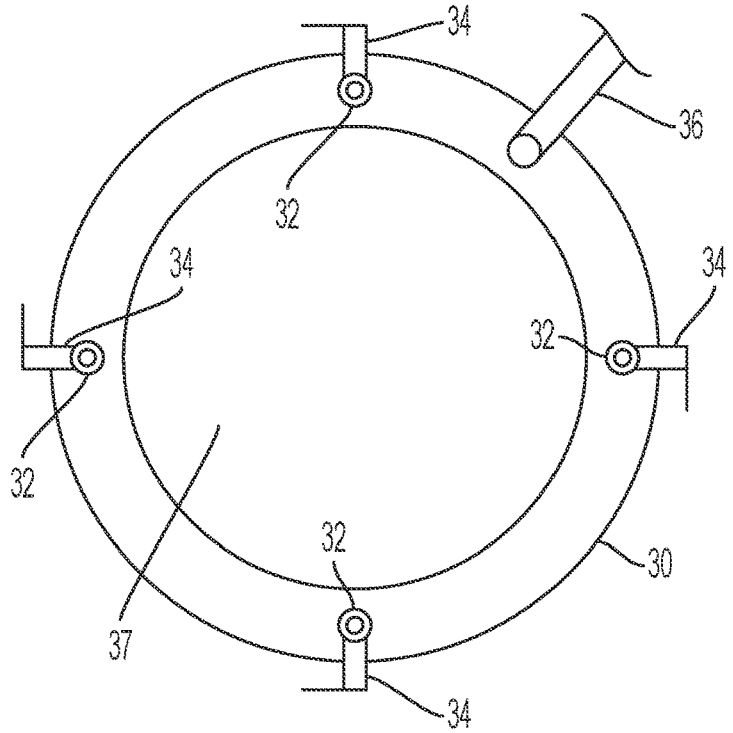
FIG. 3 illustrates a pressurized water manifold.
Figure 4:
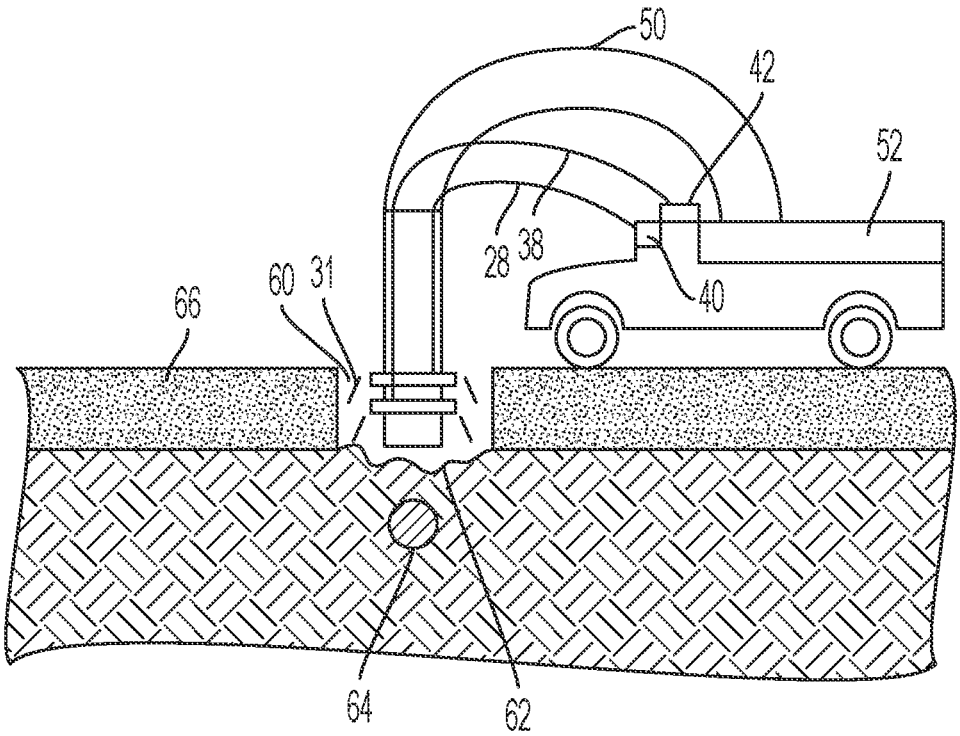
FIG. 4 illustrates a method of using the vacuum nozzle to remove dirt surrounding a buried utility.
Figure 5:
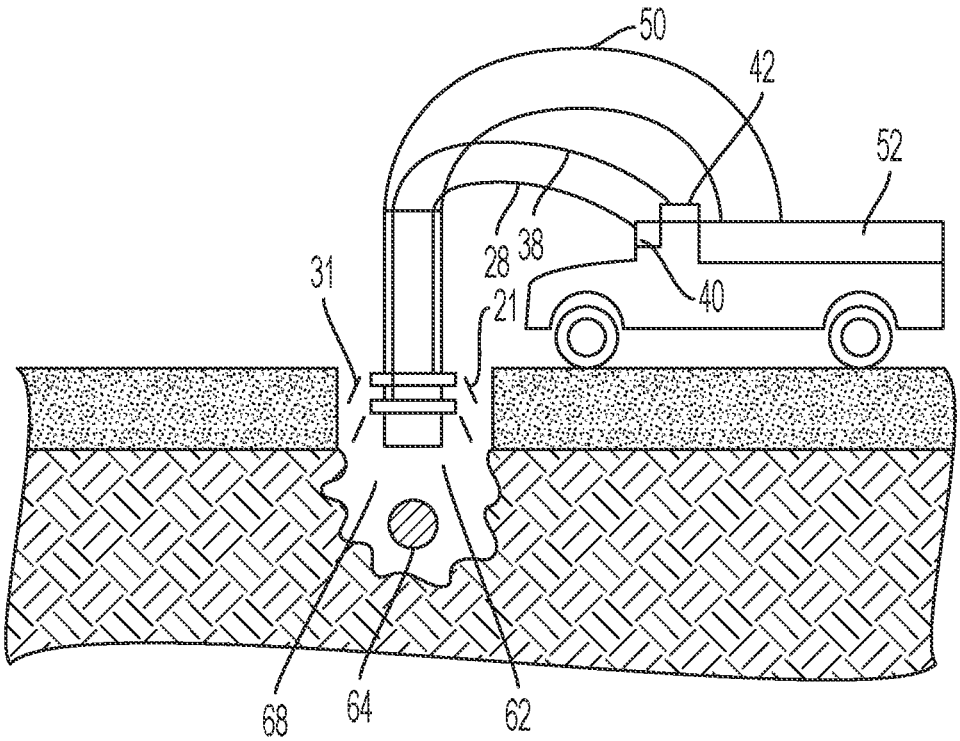
FIG. 5 illustrates a method of using the vacuum nozzle to remove dirt surrounding a buried utility.
Figure 6:
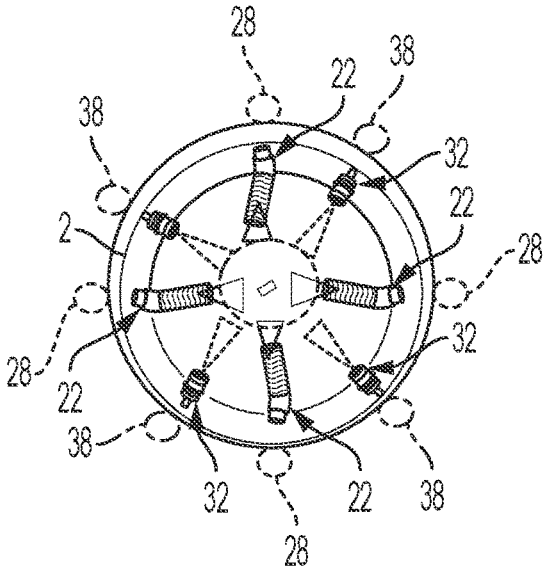
FIG. 6 illustrates a view of a vacuum nozzle.
Figure 7:
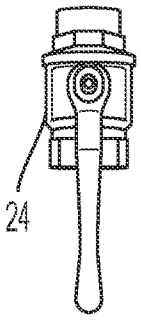
FIG. 7 illustrates a main compressed air valve.
Figure 8:
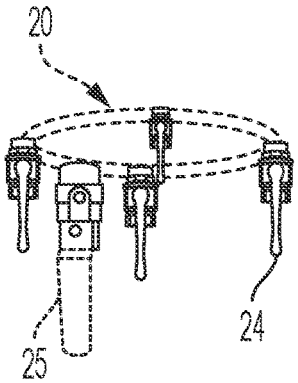
FIG. 8 illustrates a view of a compressed air manifold.
Figure 9:
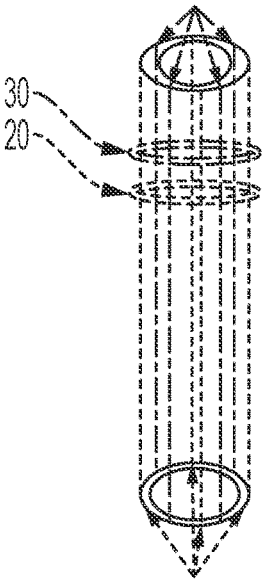
FIG. 9 illustrates a vacuum nozzle.
Figure 10:
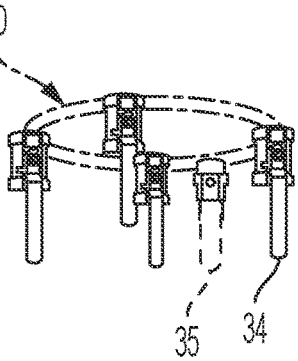
FIG. 10 illustrates a view of a pressurized water manifold.
Figure 11:
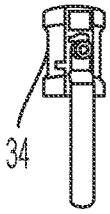
FIG. 11 illustrates a view of a main pressurized water valve.
Figure 12:
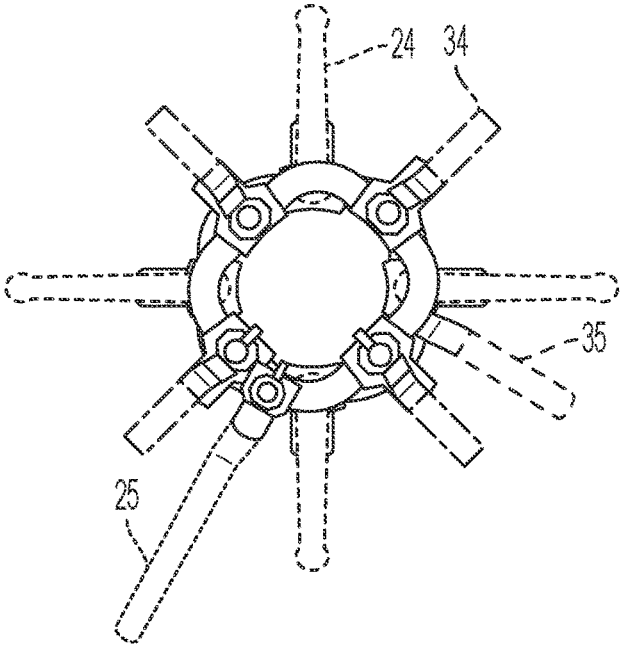
FIG. 12 illustrates a view of a pressurized water manifold and a compressed air manifold.
Figure 13:
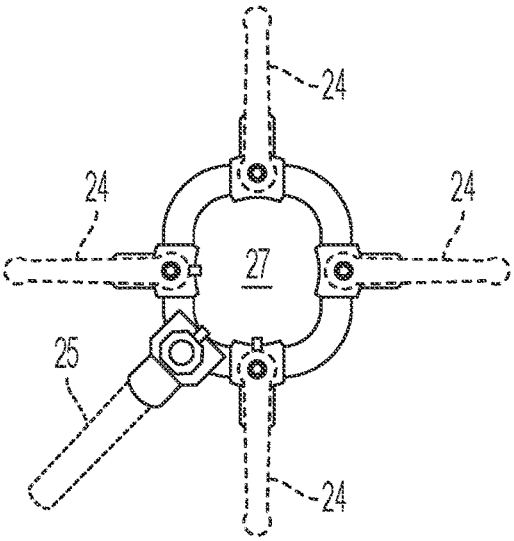
FIG. 13 illustrates a view of a compressed air manifold.
Figure 14:
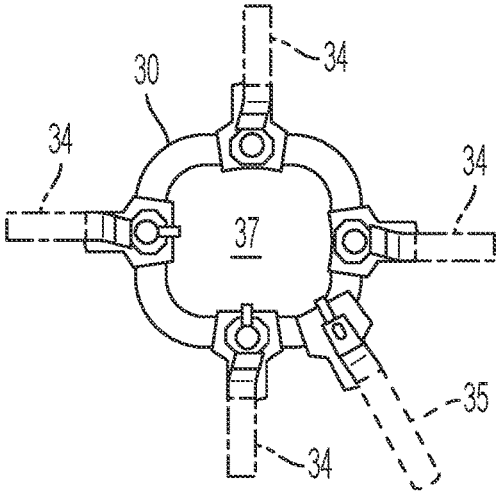
FIG. 14 illustrates a view of a pressurized water manifold.
Figure 15:
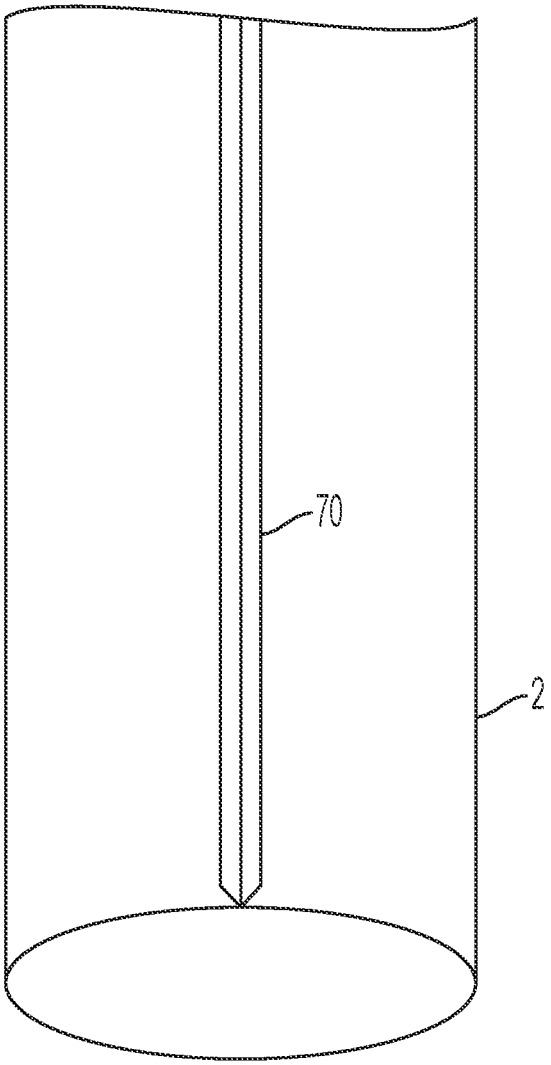
FIG. 15 illustrates a side view of a vacuum nozzle.
Figure 16:
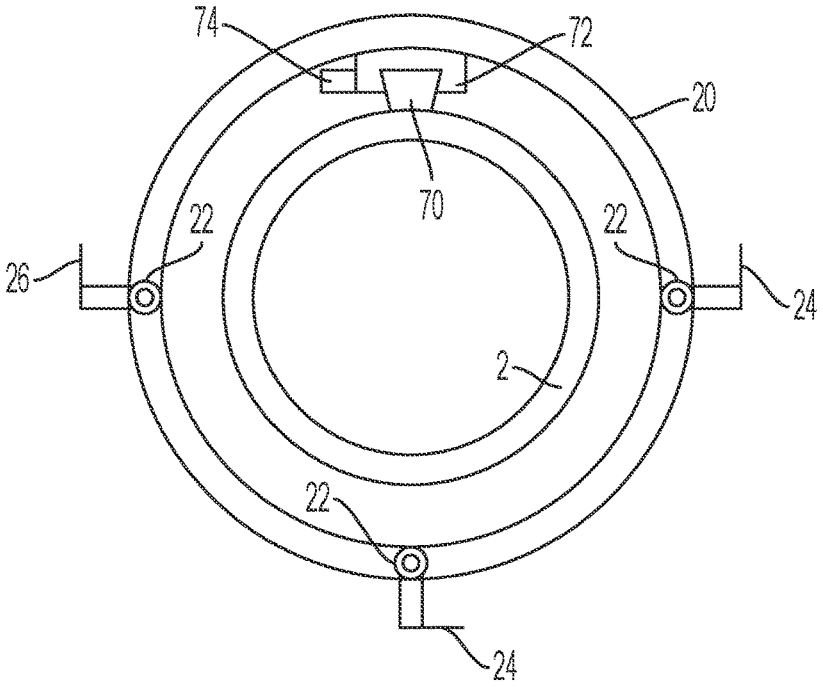
FIG. 16 illustrates an end view of a vacuum nozzle.
Figure 17:
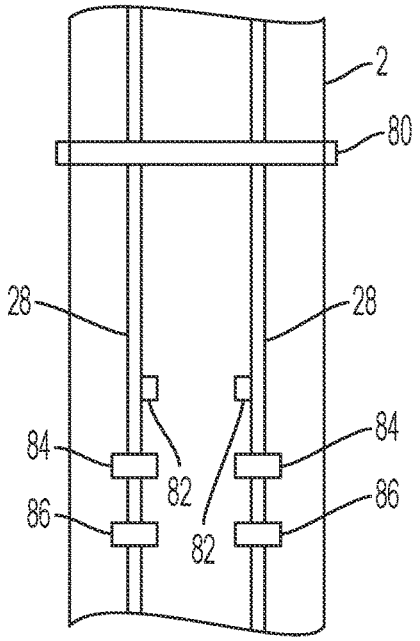
FIG. 17 illustrates a side view of a vacuum nozzle.
Figure 18:
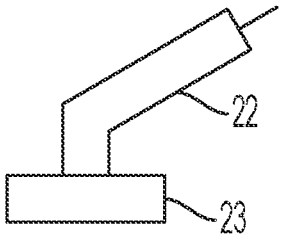
FIG. 18 illustrates a rotatable compressed air nozzle.
Figure 19:
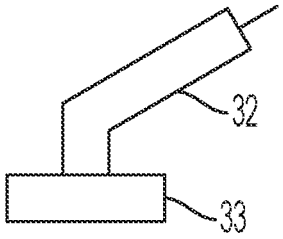
FIG. 19 illustrates a rotatable pressurized water nozzle.
Figure 20:
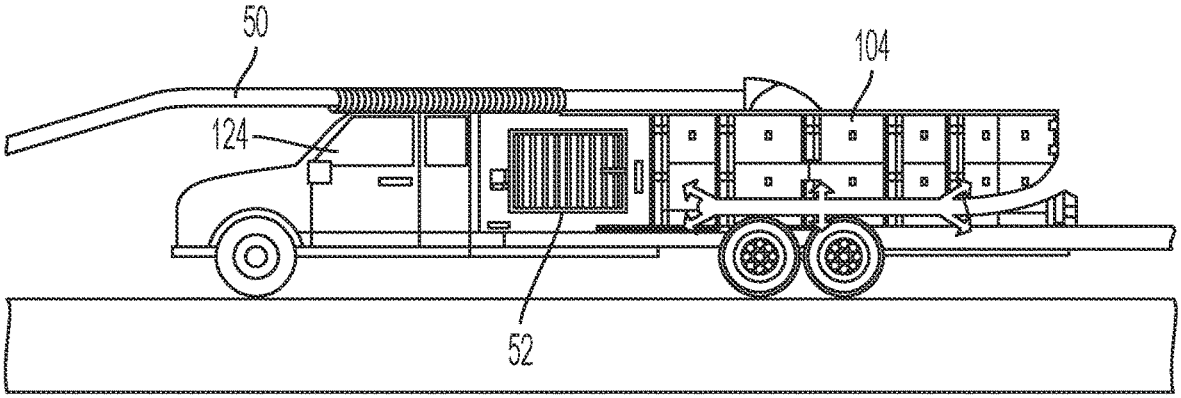
FIG. 20 illustrates a vacuum truck.
Figure 21:
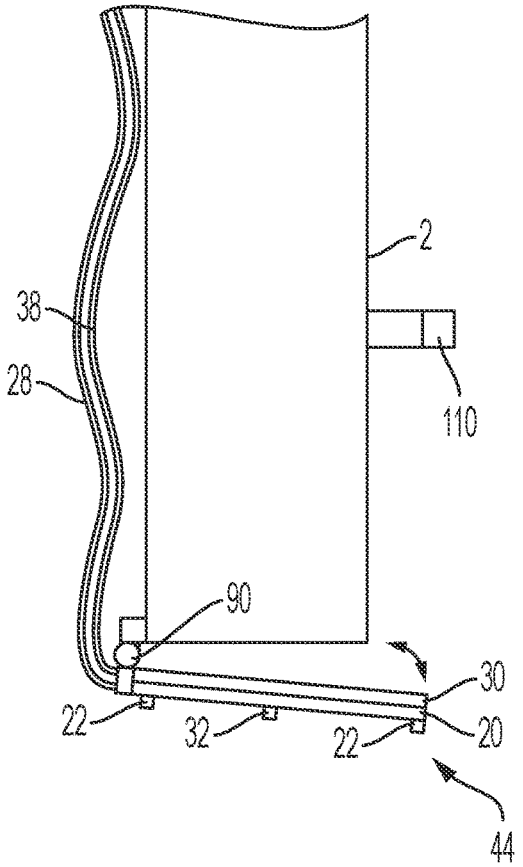
FIG. 21 illustrates a vacuum nozzle having a movable head unit.
Figure 22:
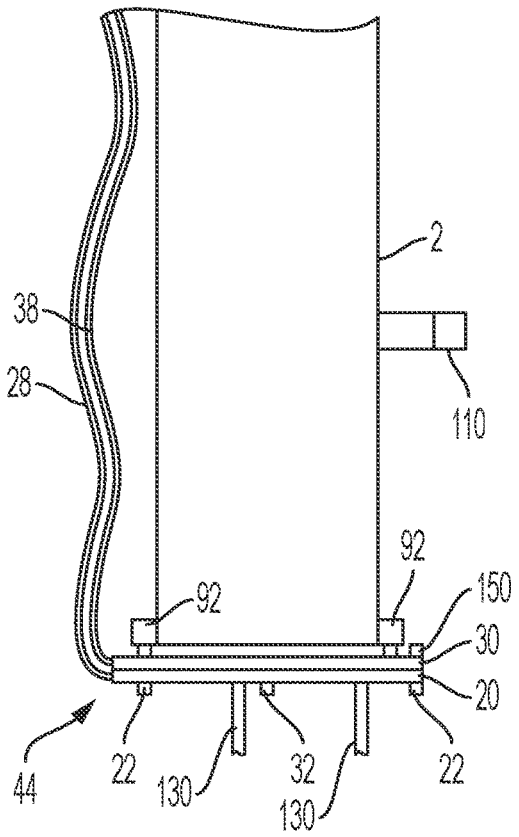
FIG. 22 illustrates a vacuum nozzle having a rotatable head unit.
Figure 23:
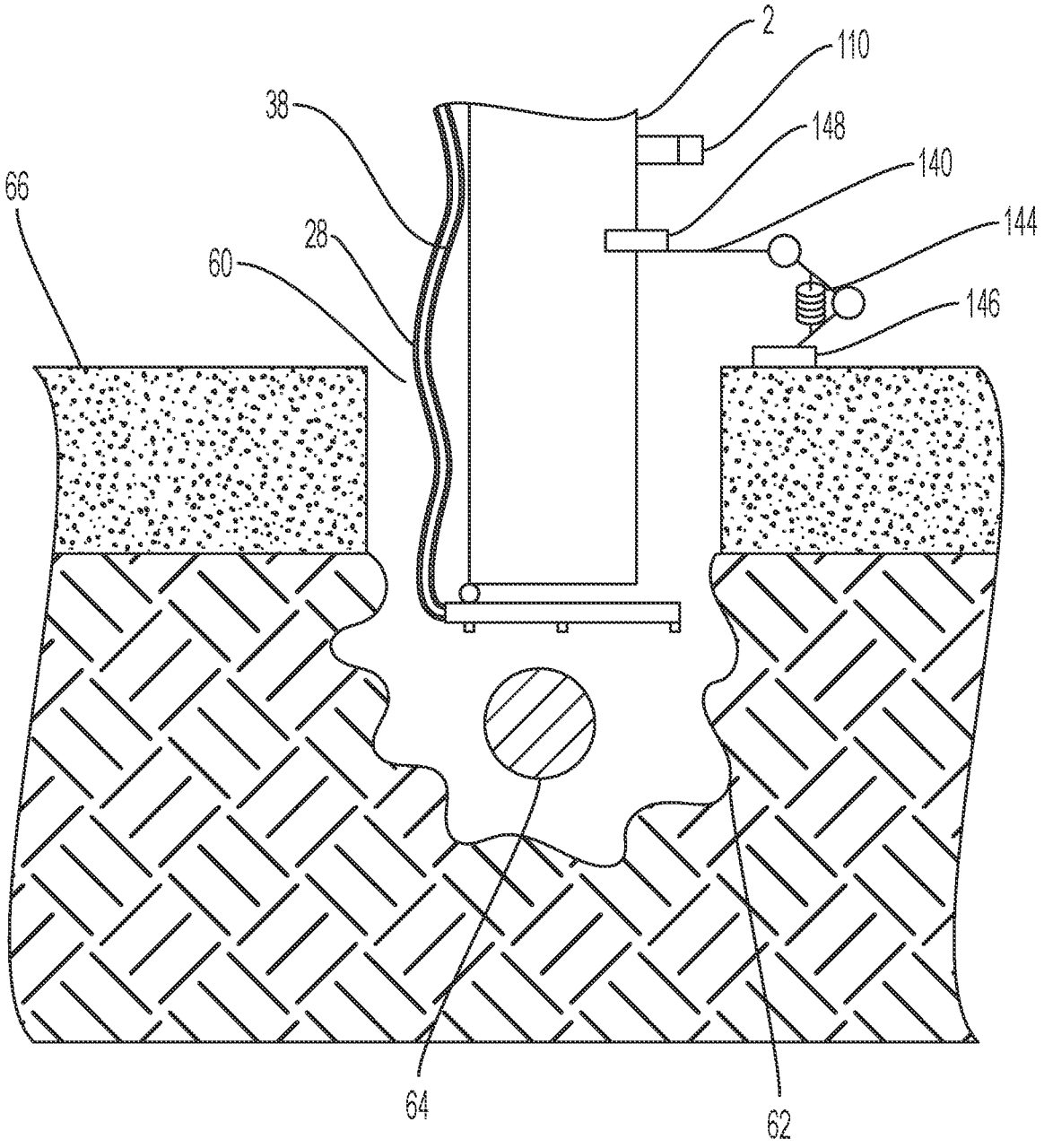
FIG. 23 illustrates a method of using the vacuum nozzle having a head unit and a lifting device.
Figure 24:
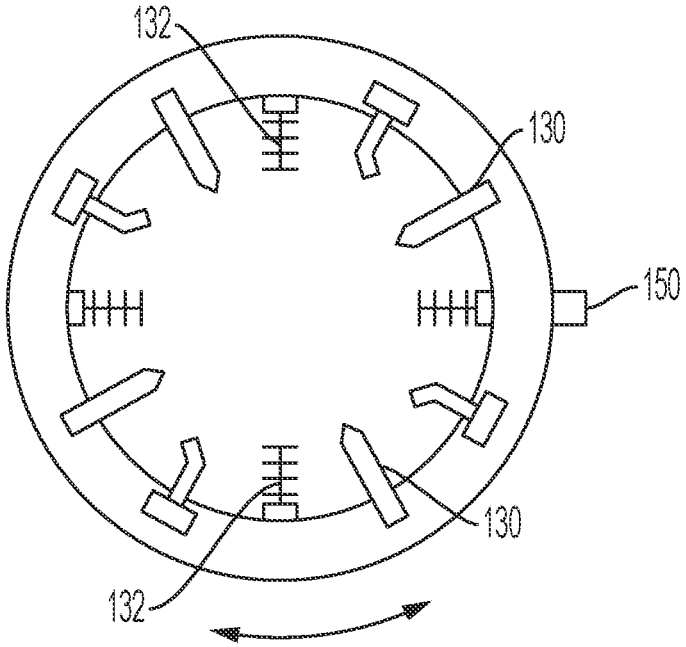
FIG. 24 illustrates a view of a rotatable head unit.
Figure 25:
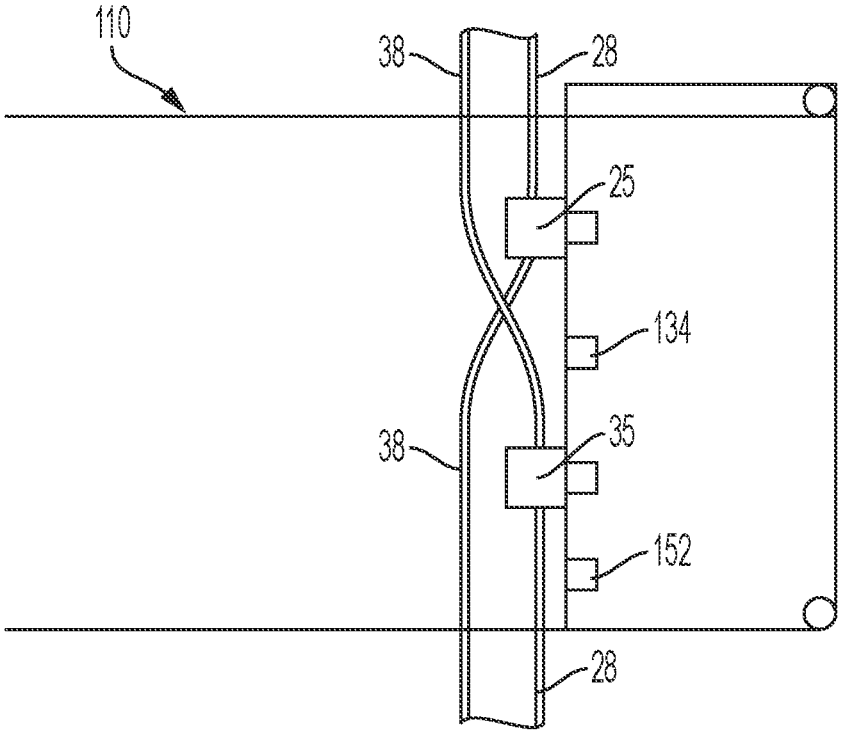
FIG. 25 illustrates a view of a handle.
Figure 26:
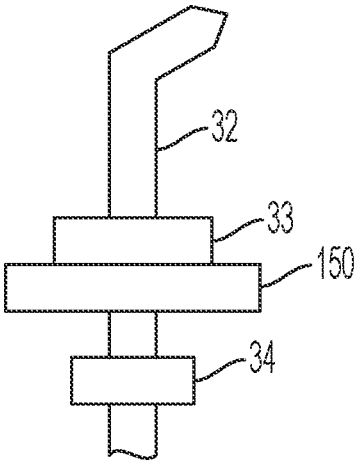
FIG. 26 illustrates a rotatable pressurized water valve.
Figure 27:
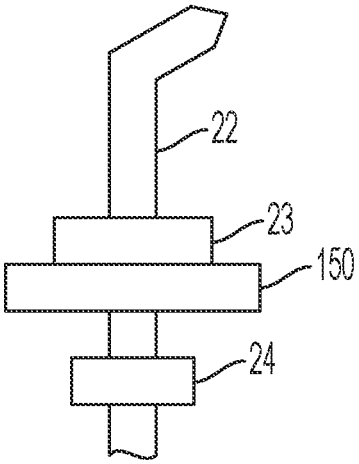
FIG. 27 illustrates a rotatable compressed air valve.
Figure 28:
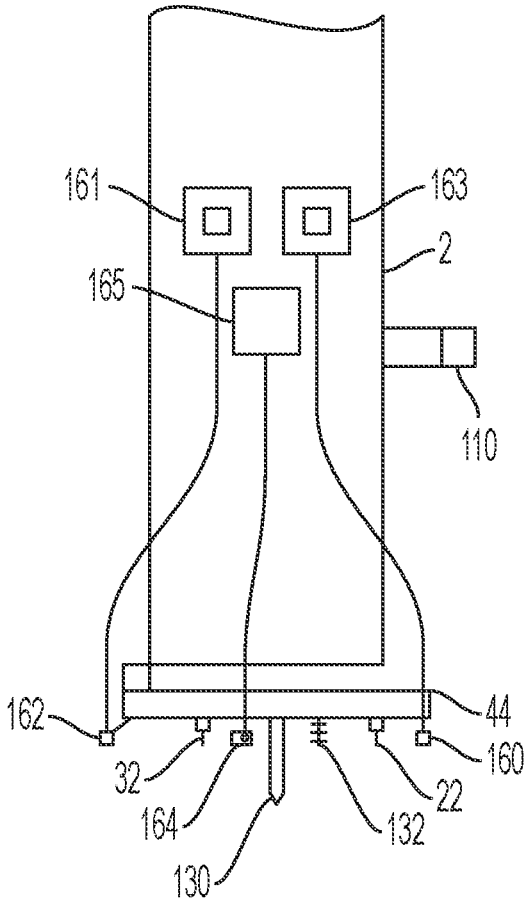
FIG. 28 illustrates a head unit having safety devices.
Figure 29:
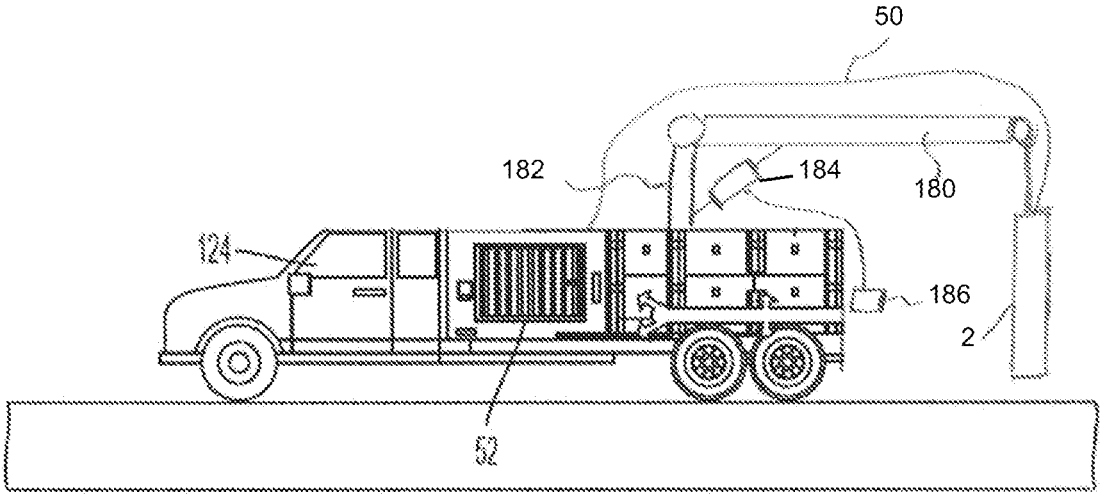
FIG. 29 illustrates an embodiment of a boom supporting the vacuum nozzle.
Figure 30:
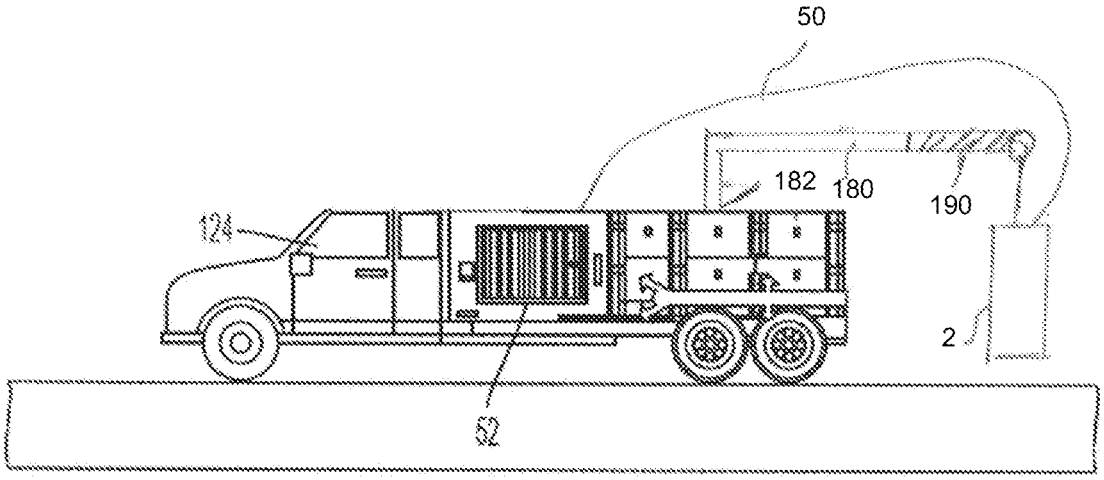
FIG. 30 illustrates an embodiment of a boom supporting the vacuum nozzle.

In the following description, for purposes of explanation and not limitation, specific details are set forth, such as particular networks, communication systems, computers, terminals, devices, components, techniques, data and network protocols, software products and systems, operating systems, development interfaces, hardware, etc. in order to provide a thorough understanding of the present invention with reference to the attached non-limiting figures.

However, it will be apparent to one skilled in the art that the present invention may be practiced in other embodiments that depart from these specific details. Detailed descriptions of well-known networks, communication systems, computers, terminals, devices, components, techniques, data and network protocols, software products and systems, operating systems, development interfaces, and hardware are omitted so as not to obscure the description.

During installation of the optical fiber cable, a microtrencher is used to cut a microtrench in the roadway, optical fiber cable and/or innerduct/microduct is then laid in the microtrench, and then the microtrench is filled with a fill and sealant over the optical fiber cable and/or innerduct/microduct to protect them from the environment. When the microtench crosses a buried utility 64 precautions must be taken before cutting the microtrench.

After location of the buried utility 64 is determined, an access hole 60 is formed in the roadway 66 over the buried utility 64. The dirt 62 surrounding the buried utility 64 must be carefully removed without damaging the buried utility 64. A vacuum nozzle 2 is lowered into the access hole 60. The vacuum nozzle 2 is connected to a source of vacuum 52 by a vacuum hose 50. When a vacuum is applied to the nozzle 2, dirt 62 is vacuumed up into the nozzle 2, travels through the vacuum hose 50 and into a storage container. The vacuum hose 50 can be any desired size, for example from 2 to 24 inches, preferably 8" inch diameter hoses.

The dirt 62 surrounding the buried utility 64 is often hard to remove, since it can comprise clay, rocks, gravel, organic matter, or other materials, and can be compacted. The present invention solves this problem by using a spray device configured for spraying compressed air 21, pressured water 31, or a combination of compressed air 21 and pressurized water 31 into the dirt 62 to loosen the dirt 62 so that the dirt 62 can be more easily vacuumed into the vacuum nozzle 2.

The vacuum nozzle 2 comprises an elongated tube or other hollow shape defining an inside chamber extending through a length of the vacuum nozzle 2. The vacuum nozzle 2 can be sized as desired. For example, the vacuum nozzle 2 can have an inside diameter of about 2 to about 24 inches. The vacuum nozzle 2 has an opening 4 on one end for vacuuming dirt 62 into the vacuum nozzle 2 and at an opposing end a vacuum hose attachment 6 for attaching the vacuum nozzle 2 to the vacuum hose 50. The vacuum nozzle 2 can be formed from any suitable material, such as plastics, polymers, composites or metals.

An example of a spray device is a compressed air manifold 20 having an opening 27 sized so that the manifold 20 can encircle the vacuum nozzle 2 as shown in FIG. 1. The manifold 20 comprises a hollow chamber and is configured to contain compressed air. The manifold 20 comprises a compressed air attachment 26. A compressed air hose 28 can be used to connect the compressed air attachment 26 to a source of compressed air 40. At least one compressed air nozzle 22 is connected to the manifold, preferably a plurality of compressed air nozzles 22 are connected to the manifold 20. A main compressed air valve 25 can be used regulate the amount of compressed air from the source of compressed air 40 supplied to the manifold 20. A compressed air valve 24 can be used to regulate the amount of compressed air from the manifold 20 to the compressed air nozzle 22. Each of the compressed air nozzles 22 can have an associated compressed air valve 24.

The compressed air nozzle 22 can be stationary during use or can have a swivel base 23 to allow the compressed air nozzle 22 to rotate during use so that the flow of compressed air 21 from the compressed air nozzle 22 is moved around in the access hole 60 to break up the dirt 62 surrounding the buried utility 64.

The manifold 20 can be placed at a desired position on the vacuum nozzle 2. The manifold 20 can be secured in a desired position on the vacuum nozzle 2 using any desired locking structure. For example, the vacuum nozzle 2 can comprise a rail 70 along a length of the vacuum nozzle 2. The manifold 20 can comprise a rail guide 72 that slides on the rail 70 and a rail lock 74 that locks the rail guide 72 at a desired position on the rail 70. The rail guide 72 can be configured to slide up and down the rail 70 when the rail lock 74 is in an open position so that the manifold 20 can be moved to a desired position on the vacuum nozzle 2. The manifold 20 can be formed from any suitable material, such as plastics, polymers, composites or metals, with metal being the preferred material. A preferred manifold 20 is formed from a steel tube bent into a circular shape.

Air compressors are now well known. The source of compressed air 40 can be any suitable air compressor.

Another example of a spray device is a pressurized water manifold 30 having an opening 37 sized so that the manifold 30 can encircle the vacuum nozzle 2 as shown in FIG. 1. The manifold 30 comprises a hollow chamber and is configured to contain pressurized water. The manifold 30 comprises a pressurized water attachment 36. A pressurized water hose 38 can be used to connect the pressurized water attachment 36 to a source of pressurized water 42. At least one pressurized water nozzle 32 is connected to the manifold 30, preferably a plurality of pressurized water nozzles 32 are connected to the manifold 30. A main pressurized water valve 35 can be used regulate the amount of pressurized water from the source of pressurized water 42 supplied to the manifold 30. A pressurized water valve 34 can be used to regulate the amount of pressurized water from the manifold 30 to the pressurized water nozzle 32. Each of the pressurized water nozzles 32 can have an associated pressurized water valve 34.

The pressurized water nozzle 32 can be stationary during use or can have a swivel base 33 to allow the pressurized water nozzle 32 to rotate during use so that the flow of pressurized water 31 from the pressurized water nozzle 32 is moved around in the access hole 60 to break up the dirt 62 surrounding the buried utility 64.

The manifold 30 can be placed at a desired position on the vacuum nozzle 2. The manifold 30 can be secured in a desired position on the vacuum nozzle 2 using any desired locking structure. For example, the vacuum nozzle 2 can comprise a rail 70 along a length of the vacuum nozzle 2. The manifold 30 can comprise a rail guide 72 that slides on the rail 70 and a rail lock 74 that locks the rail guide 72 at a desired position on the rail 70. The rail guide 72 can be configured to slide up and down the rail 70 when the rail lock 74 is in an open position so that the manifold 30 can be moved to a desired position on the vacuum nozzle 2. The manifold 30 can be formed from any suitable material, such as plastics, polymers, composites or metals, with metal being the preferred material. A preferred manifold 30 is formed from a steel tube bent into a circular shape.

High pressure washers that pressurize water from a source of water are now well known. The source of pressurized water 42 can be any suitable high pressure washer connected to a source of water. The source of water can be a city source of water or water stored in a container.

Vacuum pumps and vacuum trucks are now well known. The source of vacuum 52 can be any desired vacuum device, such as those made by SCAG Giant Vac., DR Power, Vermeer, and Billy Goat. A preferred source of vacuum 52 comprises a Guzzler vacuum truck, www.guzzler.com. The Guzzler type vacuum truck 124 has a large storage container 104 for holding dirt and a source of vacuum 52 for creating a vacuum in the storage container 104.

In another embodiment shown in FIGS. 21-24, the spray device can comprise a head unit 44 formed by joining the manifolds 20 and 30 together. The head unit 44 can be mounted at the opening of the nozzle 2. The head unit 44 supplies pressurized water from the pressurized water hose 38 to the pressurized water nozzle(s) 32. The head unit 44 supplies compressed air from the compressed air hose 28 to the compressed air nozzle(s) 22. The head unit 44 can be mounted to the vacuum nozzle 2 by a hinge mechanism 90 that allows the head unit 44 to pivot in relation to the vacuum nozzle 2. The head unit 44 can be mounted to the vacuum nozzle 2 by a rotation mechanism 92 that allows the head unit 44 to rotate about a central axis. For hard to penetrate or remove dirt, a vibrating device 150, such as an ultrasonic transducer or shaker can be mounted on any of the head unit 44, compressed air nozzle 22, pressurized water nozzle 32, or on the manifolds 20, 30, to vibrate the air, water or dirt. The compressed air valve 24 and the pressurized water valve 34 can be configured to pulse the compressed air flow 21 or pressurized water flow 31. Spike(s) 130 can be added to the head unit 44 or vacuum nozzle 2 to help break of the dirt. The vibration device 150 can be used to vibrate the entire manifold 20, 30 and/or head unit 44 so that any devices connected to the manifold 20, 30 and/or head unit 44 are also vibrated when the vibration device 150 is activated. A vibration activation switch 152 can be utilized to control the vibration device 150.

At least one vibrating or rotating brush 132 can be attached to any of the manifolds 20, 30, the head unit 44, or can be mounted on an independent manifold. The brush 132 can be any desired size and shape, such as from about 1 to about 8 inches in diameter. The brush(s) 132 can be mounted to the manifolds 20, 30 and/or head unit 44. Preferably, a plurality of brushes 132 are provided. An activation switch 134 can connected to the nozzle 2, such as at the handle 110, for controlling the on/off and/or speed of the vibration or rotation of the brush 132. The brush 132 can be formed of any suitable material, such as steel, plastic, nylon, fiberglass, natural fibers, and synthetic fibers. The rotation of the brush 132 can be provided by any suitable rotation device, such as electric motors or driven by compressed air or pressurized water motors. The brush 132 can also located where the compressed air stream 21 or pressurized water stream 31 contacts the brush 132 to cause the brush 132 to spin rapidly which will aid in the loosening of the debris in the pothole. A motorized manifold can be used to enable the brushes 132 to spin simultaneously or individually and a fixed or variable speed. The brushes 132 are configured to loosen the sub-surface materials but at the same time not damage any existing utilities.

The vacuum nozzle 2 can be provided with safety devices. For example, a voltage detector 160 can be connected to the any of the vacuum nozzle 2, manifolds 20, 30 or head unit 44. The voltage detector 160 can be configured to provide an alarm and/or shut off power, compressed air and/or pressurized water in the event that stray voltage is detected by the voltage detector 160. A voltage meter 61 can be provided on the vacuum nozzle 2 to show stray voltage readings by the voltage detector 160. Voltage detectors are now well-known and any suitable voltage detector can be utilized in the present invention. Another example of a safety device is a fume detector 162 that can be connected to the any of the vacuum nozzle 2, manifolds 20, 30 or head unit 44. The fume detector 162 can be configured to sense any hazardous or toxic fumes being emitted during the cleaning process. A gas monitor 163 can be mounted on the vacuum nozzle 2 to show an amount of gas fumes detected be fume detector 162. Gas fume detectors are now well-known and any suitable gas fume detector can be utilized in the present invention. The fume detector 162 can be configured to provide an alarm and/or shut off power, compressed air and/or pressurized water in the event that fumes are detected by the fume detector 162. Another example of a safety device is a video camera 164 that can be connected to the any of the vacuum nozzle 2, manifolds 20, 30 or head unit 44 to confirm that the buried utility 64 has been sufficiently uncovered. A monitor 165 can be connected to the video camera 164. The captured video can be used to confirm compliance with city and state laws. Video cameras and monitors are now well-known and any suitable video camera and monitor can be utilized in the present invention. For example, the monitor 165 can be smart phone, such as an android or i-phone, and the video camera 164 can be bore hole scope connected to the smart phone.

The nozzle 2 can be heavy and use may result in physical exertion. A handle 110 can be mounted on the nozzle 2 to help control the nozzle 2 during use. The main pressurized water valve 35 and main compressed air valve 25 can be mounted on or near the handle 110 for easy control of the flow of compressed air to the compressed air nozzles 22 and control of the flow of pressurized water to the pressurized water valves 32.

To make the vacuum nozzle 2 lighter for easier use, a nozzle lift assist 144 can be mounted on the vacuum nozzle 2 by a nozzle connector 140. The lift assist 144 can be connected to a ground base 146 that is configured to contact the surface of the roadway or ground. The nozzle lift assist 144 is connected to the vacuum nozzle 2 so that the nozzle lift assist 144 supports at least a portion of the weight of the vacuum nozzle 2. Lift assist devices are now well-known and any suitable lift assist can be utilized, such as springs, gas lift cylinders, douper 200N gas struts, pneumatic, or hydraulic can be utilized. The lift assist can also be what is known as a zero gravity tool balancer. Any suitable zero gravity tool balancer (also referred to as a torque arm) can be utilized, such as those commercially sold by Ergonomic Partners, Ingersoll Rand, Grainger, MSC Industrial Design, Kimco, and Jensen Tools.

If desired the manually operated valves described and shown herein can be replaced with automatic or electronically controlled valves connected to a control system. The flow and pressures of the air 21 and water 31 can be precisely controlled to avoid damaging the buried utility. The exemplary manifolds 20, 30 disclosed herein can be modified as desired, such as only partially encircling the vacuum nozzle 2. Alternatively, the nozzles 24 and 34 can be mounted directly on the vacuum nozzle 2 instead of on a manifold.

The compressed air hose 28 and the pressurized water hose 38 can be secured to the vacuum nozzle 2 by any suitable securing device, such as a strap 80, weld 82, clip 84, or claim 86. The manifold 20 and manifold 30 can be held in place on the vacuum nozzle 2 by the secured compressed air hose 28 and the secured pressurized water hose 38. Alternatively, the nozzles 24 and 34 can be connected to associated compressed air hoses 28 and pressurized water hoses 38 and the nozzles 24 and 34 can be secured in place by securing the compressed air hoses 28 and pressurized water hoses 38 to the vacuum nozzle 2.

The weight of the vacuum nozzle 2 can also be supported by a boom 180 mounted on the vacuum truck 124, or other vehicle. The boom 180 can be mounted to the vacuum truck 124 by a rotatable boom mount 182 that allows the boom 180 to pivot from side to side. The boom 180 can be movably mounted to the rotatable boom mount 182 so that the boom 180 can be lifted and lowered. An actuator 184 can be used to raise and lower the boom 180. Any suitable actuator 184 can be utilized, such as hydraulic, pneumatic, or electric. An actuator controller 186 can be used to control the actuator 184. The boom 180 can include a lift assist 190 that reduces the weight of the vacuum nozzle 2 so that the user can lift and lower the vacuum nozzle 2 without lifting and lowering the boom. The lift assist 190 can be any suitable lift assist, such as springs, gas lift cylinders, douper 200N gas struts, pneumatic, or hydraulic. In this manner, the boom 180 can be moved up/down, and left/right to place the vacuum nozzle 2 above the access hole in the roadway. Then the user can move the vacuum nozzle 2 down into the access hole using the lift assist 190 and/or by further moving the boom 180.

Terms

2 vacuum nozzle
4 vacuum nozzle opening
6 vacuum attachment
20 compressed air manifold
21 flow of compressed air
22 compressed air nozzle
23 swivel base
24 compressed air valve
25 main compressed air valve
26 compressed air attachment
27 opening for nozzle
28 compressed air hose
30 pressurized water manifold
31 flow of pressurized water
32 pressurized water nozzle
33 swivel base
34 pressurized water valve
35 main pressurized water valve
36 pressurized water attachment
37 opening for nozzle
38 pressurized water hose
40 source of compressed air
42 source of pressurized water
44 head unit
50 vacuum hose
52 source of vacuum
60 access hole in roadway
62 dirt below roadway
64 buried utility
66 roadway
68 opening surrounding buried utility
70 rail
72 rail guide
74 rail lock
80 strap
82 weld
84 clip
86 clamp
90 hinge mechanism
92 rotation mechanism
104 storage container
110 nozzle handle
124 vacuum truck
130 spike
132 brush
134 brush activation switch
140 nozzle lift assist connector
144 nozzle lift assist
146 ground base
148 suspension connector
150 vibration device
152 vibration activation switch
160 voltage detector
161 volt meter
162 fume detector
163 fume monitor
164 video camera
165 monitor
180 boom
182 rotatable boom mount
184 actuator to lift/lower boom 180
186 actuator controller
190 lift assist To facilitate an understanding of the principles and features of the various embodiments of the present invention, various illustrative embodiments are explained herein. Although example embodiments of the present invention are explained in detail, it is to be understood that other embodiments are contemplated. Accordingly, it is not intended that the present invention is limited in its scope to the details of construction and arrangement of components set forth in the following description or examples. The present invention is capable of other embodiments and of being practiced or carried out in various ways.

As used in the specification and the appended claims, the singular forms "a," "an," "is," and "the" include plural references unless the context clearly dictates otherwise. For example, reference to a component is intended also to include composition of a plurality of components. References to a composition containing "a" constituent is intended to include other constituents in addition to the one named.

Also, in describing the example embodiments, terminology will be resorted to for the sake of clarity. It is intended that each term contemplates its broadest meaning as understood by those skilled in the art and includes all technical equivalents that operate in a similar manner to accomplish a similar purpose.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified. Such other components or steps not described herein can include, but are not limited to, for example, similar components or steps that are developed after development of the disclosed technology.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention.

The invention claimed is:

1. A vacuum device for removing dirt surrounding a utility buried under a roadway comprising:

a vacuum nozzle having a diameter of about 2 to about 24 inches;

a spray device connected to the vacuum nozzle, the spray device having at least one pressurized water nozzle or compressed air nozzle, and the spray device being configured for spraying at least one of pressurized water from the pressurized water nozzle or compressed air from the compressed air nozzle into the hole to loosen the dirt surrounding the buried utility;

a compressed air manifold at least partially surrounding the vacuum nozzle, and at least one air nozzle connected to the compressed air manifold wherein the compressed air manifold is movable in relation to the vacuum nozzle so that the compressed air manifold can be positioned along a length of the vacuum nozzle; and a pressurized water manifold at least partially surrounding the vacuum nozzle, and at least one pressurized water nozzle connected to the pressurized water manifold, wherein the pressurized water manifold is movable in relation to the vacuum nozzle so that the pressurized water manifold can be positioned along a length of the vacuum nozzle.

2. The vacuum device according to claim 1, further comprising a nozzle lift assist mounted to the vacuum nozzle to reduce the weight of the vacuum nozzle.

3. The vacuum device according to claim 1, further comprising at least one spike mounted to the vacuum nozzle, the spike being configured to break of the dirt.

4. The vacuum device according to claim 1, further comprising at least one brush connected to the vacuum nozzle configured to rotate and/or vibrate.

5. The device according to claim 1, further comprising a detector connected to the vacuum nozzle, the detector configured to detect at least one of voltage or fumes.

6. The device according to claim 1, further comprising a video camera connected to the vacuum nozzle.

7. The device according to claim 1, further comprising a valve for controlling the flow of compressed air and a valve for controlling the flow of pressurized water.

8. A vacuum device for removing dirt surrounding a utility buried under a roadway comprising:

a vacuum nozzle having a diameter of about 2 to about 24 inches; and a spray device connected to the vacuum nozzle, the spray device having at least one pressurized water nozzle or compressed air nozzle, and the spray device being configured for spraying at least one of pressurized water from the pressurized water nozzle or compressed air from the compressed air nozzle into the hole to loosen the dirt surrounding the buried utility, further comprising a head unit comprising a compressed air manifold and a pressurized water manifold, the compressed air manifold being connected to the compressed air nozzle, and the pressurized water manifold being connected to the pressurized water nozzle, wherein the head unit is mounted at an opening of the vacuum nozzle, wherein the head unit is mounted to the vacuum nozzle by a hinge to allow the head unit to pivot in relation to the vacuum nozzle.

9. The device according to claim 8, further comprising a vibrating device mounted to the head unit configured to vibrate the head unit.

10. A vacuum device for removing dirt surrounding a utility buried under a roadway comprising:

a vacuum nozzle having a diameter of about 2 to about 24 inches; and a spray device connected to the vacuum nozzle, the spray device having at least one pressurized water nozzle or compressed air nozzle, and the spray device being configured for spraying at least one of pressurized water from the pressurized water nozzle or compressed air from the compressed air nozzle into the hole to loosen the dirt surrounding the buried utility, further comprising a head unit comprising a compressed air manifold and a pressurized water manifold, the compressed air manifold being connected to the compressed air nozzle, and the pressurized water manifold being connected to the pressurized water nozzle, wherein the head unit is mounted at an opening of the vacuum nozzle, wherein the head unit is mounted to the vacuum nozzle by a rotation mechanism that allows the head unit to rotate about a central axis.

* * * * *